US005784896A

United States Patent [19]

Tronnes et al.

[11] Patent Number: 5,784,896

[45] Date of Patent: Jul. 28, 1998

[54] FREEZER OR REFRIGERATOR CONSTRUCTION SUITABLE FOR FOOD SERVICE USE

[75] Inventors: Jerome Tronnes, deceased, late of Eagan, Minn.; Guy Stormo, St. Cloud, Minn.; Scott Tronnes, Las Vegas, Nev., executor of said Jerome Tronnes, deceased

[73] Assignee: White Consolidated Industries, Inc., Cleveland, Ohio

[21] Appl. No.: 823,722

[22] Filed: Mar. 25, 1997

Related U.S. Application Data

[60] Provisional application No. 60/028,781, Oct. 18, 1996.

[51] Int. Cl.[6] ..... F25D 17/04

[52] U.S. Cl. ..... 62/407; 62/285; 62/440

[58] Field of Search ..... 62/272, 285, 440, 62/441, 404, 407, 420, 419

[56] References Cited

U.S. PATENT DOCUMENTS

| | | | |
|---|---|---|---|
| 2,090,413 | 8/1937 | Gould . | |
| 2,735,274 | 2/1956 | Mann et al. . | |
| 2,782,607 | 2/1957 | Jacobs . | |
| 2,954,683 | 10/1960 | Ohlsson . | |
| 3,084,519 | 4/1963 | Hanson et al. . | |
| 3,103,797 | 9/1963 | Harley, Jr. . | |
| 3,216,217 | 11/1965 | Kesling . | |
| 3,394,559 | 7/1968 | Jones | 62/285 |
| 3,436,931 | 4/1969 | Gelbard | 62/285 |
| 3,638,449 | 2/1972 | Lichtenberger . | |
| 4,021,213 | 5/1977 | Neidhardt et al. . | |
| 4,077,229 | 3/1978 | Gelbard et al. . | |
| 4,270,364 | 6/1981 | Oonishhi et al. . | |
| 4,301,663 | 11/1981 | Hoshino . | |
| 4,944,157 | 7/1990 | Jenkins et al. . | |
| 5,319,937 | 6/1994 | Fritsch et al. . | |

*Primary Examiner*—John M. Sollecito

*Attorney, Agent, or Firm*—Pearne, Gordon, McCoy and Granger LLP

[57] ABSTRACT

A refrigeration unit for storing items to be refrigerated. The refrigeration unit includes an insulated enclosure defining a compartment, and has a top wall, a rear wall, and opposing side walls. An evaporator is disposed within the compartment and is secured to the rear wall. An evaporator cover has a top portion and a rear portion. The rear portion covers the evaporator and has a sloping rear face that slopes rearwardly and downwardly toward a drain trough. The sloping rear face directs condensate from the evaporator into the drain trough. A drain plate covers the drain trough and the sloping rear face. An angled grate is secured to the drain plate and covers an inlet to an air flow channel formed by the rear wall, and the evaporator cover and the drain plate. A fan is secured over an angled opening formed in the top portion of the evaporator cover and is operable to draw air through the air flow channel.

21 Claims, 5 Drawing Sheets

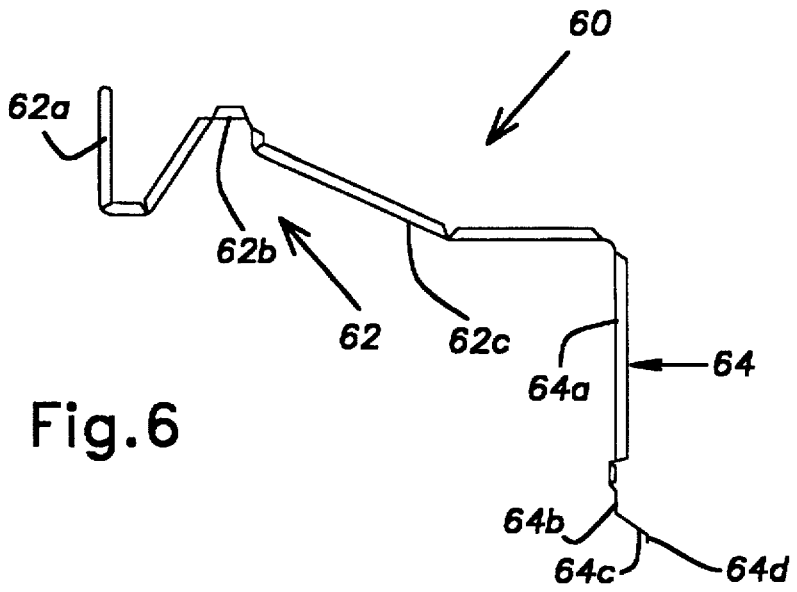
Fig.6
Fig.7
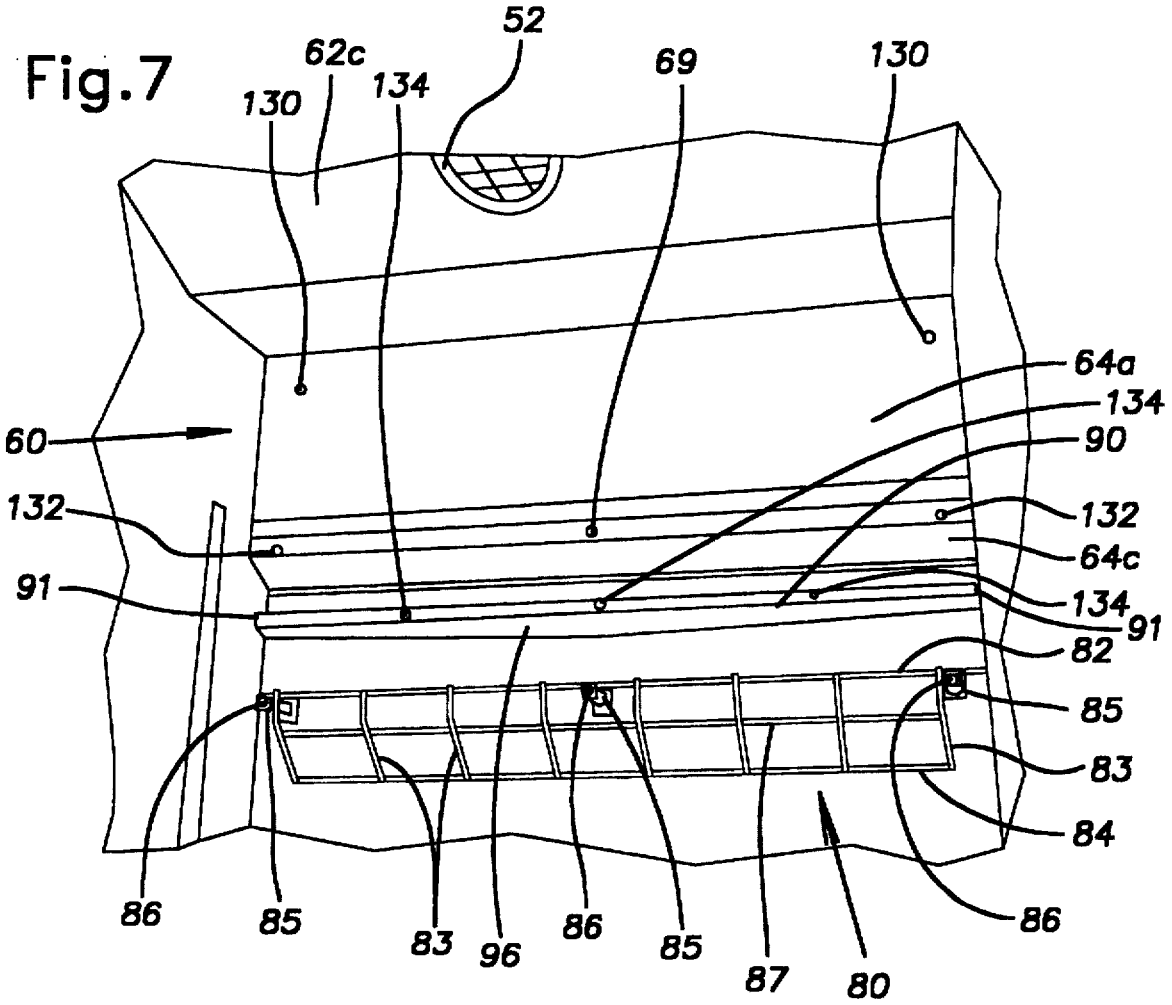

FREEZER OR REFRIGERATOR CONSTRUCTION SUITABLE FOR FOOD SERVICE USE

CROSS-REFERENCE TO RELATED APPLICATION

This application claims the benefit of U.S. Provisional application No. 60/028,781, filed Oct. 18, 1996.

BACKGROUND OF THE INVENTION

This invention relates to refrigerators in general and, more particularly, to condensate drainage and air flow systems for commercial refrigerators and freezers.

Commercial refrigerators and freezers (hereinafter collectively referred to as commercial refrigeration units) are widely used in restaurants, cafeterias, and other commercial food services. A commercial refrigeration unit typically includes an inner liner disposed within an outer cabinet. The inner liner is rectangular and has an open front closed by a door pivotally mounted to the outer cabinet. The inner liner defines a single compartment fitted with shelves to receive perishable items for refrigerated storage. A refrigeration system is provided to cool the compartment. The refrigeration system includes an evaporator, which is typically mounted to a rear wall of the inner liner. An evaporator cover is usually disposed over the evaporator and is secured to the rear wall of the liner so as to form an evaporator channel with open top and bottom ends. A drain trough is secured to the rear wall of the liner, below the bottom end of the evaporator channel. The drain trough is secured to a drain tube that extends through the liner.

A fan housing is mounted either to a top wall of the inner liner or to a top portion of the rear wall of the liner. The fan housing has an inlet adjoining the top end of the evaporator channel, and an outlet over which a fan is mounted. If the fan housing is mounted to the top wall, the fan is directed downward, whereas, if the fan housing is mounted to the rear wall, the fan is directed forward, toward the door. The fan draws air over the drain trough, and into the evaporator channel through the bottom end. Air flows upward through the evaporator channel and the fan housing, and is expelled through the outlet in the fan housing.

During an operating cycle of the refrigeration system, the evaporator cools the air passing through the evaporator channel. Moisture is removed from the air and collects on the evaporator as condensate. A defrost heater is provided in the evaporator to melt frozen condensate during a defrost cycle of the refrigeration unit. Condensate flows downward from the evaporator and is collected by the drain trough. Condensate flows through the drain trough and passes into the drain tube. A drain heater is disposed adjacent to the drain trough in order to prevent condensate in the drain trough and the drain tube from freezing.

Perishable items positioned between the bottom end of the evaporator channel and the drain trough are often contacted by condensate dripping from the evaporator. Such contact is undesirable because the condensate can contaminate the perishable items. For this reason, prior art commercial refrigeration units having the foregoing construction typically do not have unrestricted certification from the National Sanitation Foundation, and, thus, can only be used to store packaged food items.

Packaged food items positioned between the bottom end of the evaporator channel and the drain trough can also block the bottom end of the evaporator channel, thereby restricting air flow through the evaporator channel. Air flow through the evaporator channel can also be restricted by packaged food items positioned in front of the outlet of the fan housing.

Based upon the foregoing, there is a need in the art for a refrigeration unit having a construction that prevents condensate from dripping onto stored items, and that prevents the stored items from restricting air flow in the refrigeration unit. The present invention is directed to such a refrigeration unit.

SUMMARY OF THE INVENTION

It therefore would be desirable, and is an advantage of the present invention, to provide a refrigeration unit that prevents condensate from dripping onto stored items and that prevents the stored items from restricting air flow in the refrigeration unit. In accordance with the present invention, a refrigeration unit is provided having an evaporator plate and a drain plate. The refrigeration unit also includes an insulated enclosure, an evaporator and a drain trough. The enclosure defines a compartment and has a top wall, a rear wall and opposing side walls. The evaporator is disposed within the compartment and is secured to the rear wall. The drain trough is secured to the rear wall below the evaporator. The evaporator plate covers the evaporator and has a lower portion sloping rearwardly and downwardly toward the drain trough. The lower portion directs condensate from the evaporator into the drain trough. The drain plate covers the lower portion of the evaporator plate and the drain trough so as to prevent storage items from coming into contact with condensate dripping into the drain trough from the lower portion of the evaporator plate. The drain plate, in conjunction with the evaporator plate, forms a rear channel with the rear wall.

Also provided in accordance with the present invention is a refrigeration unit having a rear plate and a grate. The refrigeration unit also includes an insulated enclosure, an evaporator, and a drain trough. The insulated enclosure defines a compartment and has a top wall, a rear wall and opposing side walls. The rear plate is spaced forward from the rear wall so as to form a rear channel therewith. The rear plate has a lower end spaced forward from the rear wall so as to form an inlet for the rear channel. The evaporator is disposed within the rear channel. The drain trough is disposed within the rear channel below the evaporator. The grate covers the inlet to the rear channel so as to prevent storage items from being pressed up against the lower end of the rear plate and blocking air flow into the inlet of the rear channel.

Also provided in accordance with the present invention is a refrigeration unit having an evaporator plate, a top plate, and a fan. The refrigeration unit also includes an insulated enclosure, an evaporator, and a drain trough. The enclosure defines a compartment and has a top wall, a rear wall and opposing side walls. The evaporator is disposed within the compartment and is secured to the rear wall. The drain trough is secured to the rear wall below the evaporator. The evaporator plate covers the evaporator and forms an evaporator channel with the rear wall. The evaporator plate has a lower portion sloping rearwardly and downwardly toward the drain trough. The lower portion directs condensate from the evaporator into the drain trough. The top plate has an angled portion defining an opening. The top plate is spaced downward from the top wall so as to form a top channel therewith. The top channel adjoins the evaporator channel. The fan is disposed within the top channel and is secured over the opening so as to be angled. The fan is operable to draw air through the evaporator channel and the top channel, and to expel the air into the compartment through the opening at an angle.

BRIEF DESCRIPTION OF THE DRAWINGS

The features, aspects, and advantages of the present invention will become better understood with regard to the following description, appended claims, and accompanying drawings where:

FIG. 6 shows a side view of the evaporator cover; and

FIG. 7 shows an enlarged front perspective view of a portion of the refrigeration unit with the evaporator cover mounted to a liner.

DETAILED DESCRIPTION OF THE PREFERRED EMBODIMENTS

Figure 1:
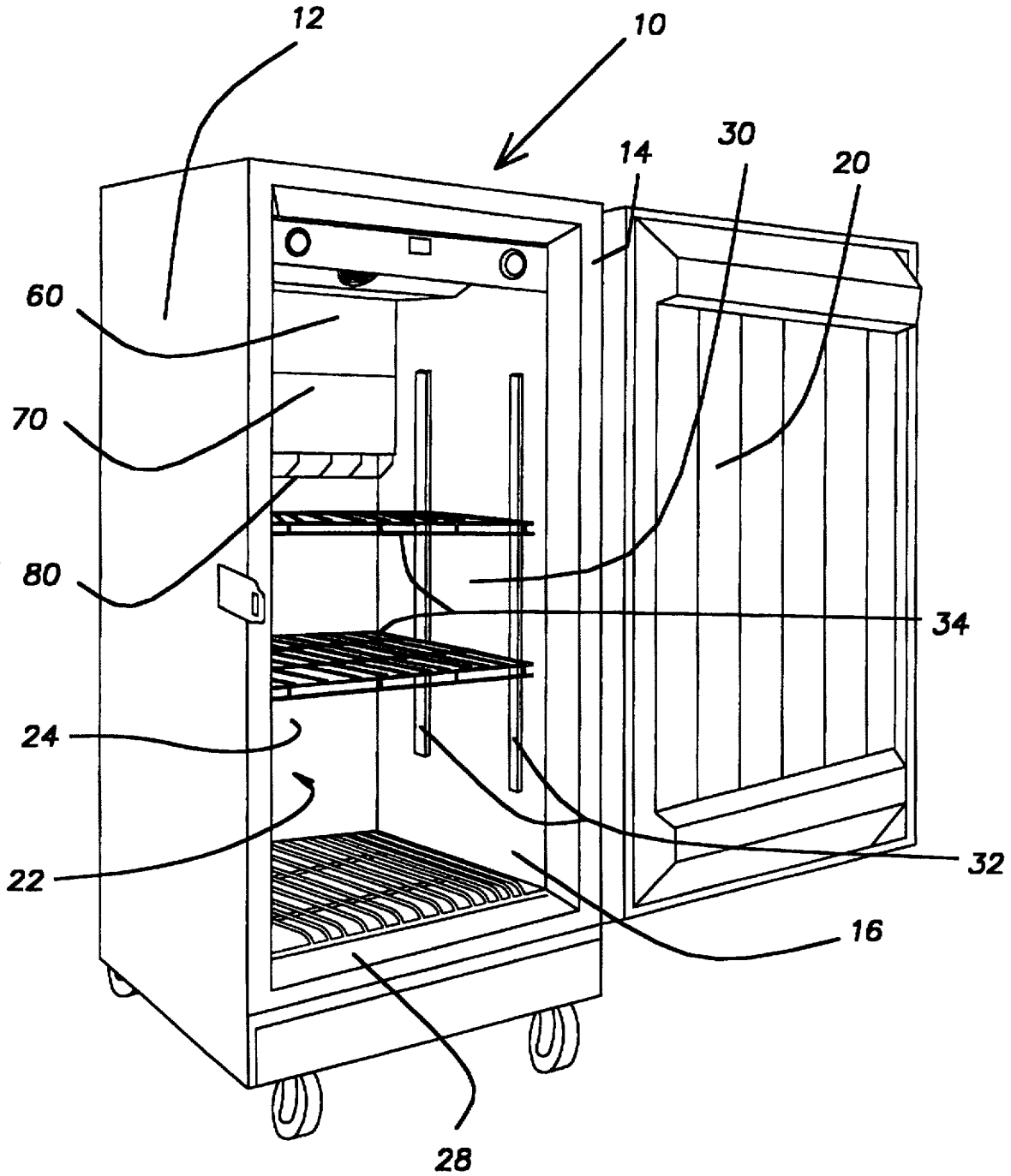
FIG. 1 shows a front perspective view of a refrigeration unit.

It should be noted that in the detailed description which follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form.

Referring now to FIG. 1 there is shown a front perspective view of a refrigeration unit 10 for use in commercial food services. The refrigeration unit 10 includes an outer cabinet 12 and an inner liner 14 separated by a spacing filled with thermal insulation 13 (shown in FIG. 2). The refrigeration unit 10 is rectangular and defines a front opening 16. A door 20 is pivotally mounted to the outer cabinet 12 and is movable between an open position (shown in FIG. 1), wherein the door 20 is spaced from the front opening 16, and a closed position (shown in FIG. 2), wherein the door 20 covers the front opening 16.

The liner 14 defines a compartment 22 and includes a rear wall 24, a top wall 26 (shown in FIG. 2), a bottom wall 28 and a pair of opposing side walls 30. A pair of rails 32 are secured to each of the side walls 30. Each of the rails 32 defines a plurality of vertically-spaced openings. Shelves 34 are mounted to the rails 32 by clips (not shown) inserted into the openings in the rails 32. The clips are movable between the openings so as to permit vertical adjustment of the shelves 34. Perishable food items are supported upon the shelves 34 for refrigerated storage inside the compartment 22.

Figure 2:
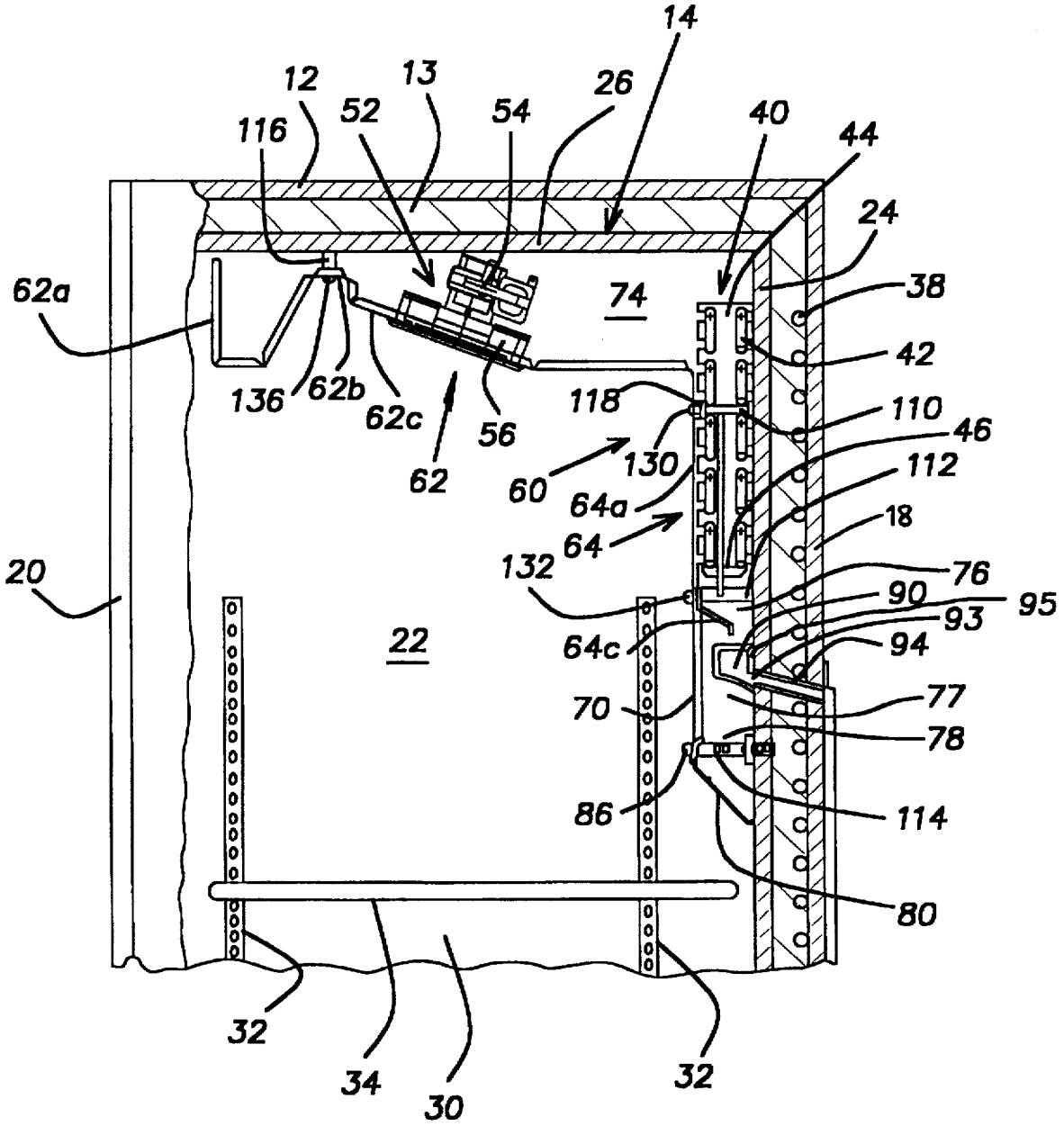
FIG. 2 shows an enlarged side sectional view of a portion of the refrigeration unit.

Referring now to FIG. 2 there is shown a side sectional view of a portion of the refrigeration unit 10. A refrigeration system is provided to cool the compartment 22. The refrigeration system is a closed recirculating system filled with a suitable refrigerant such as R12 or R134a. The refrigeration system generally includes an electric motor-driven compressor (not shown), condenser tubing 38, a capillary tube (not shown), and an evaporator 40. The evaporator 40 is mounted inside the compartment 22, whereas the compressor and the condenser tubing 38 are mounted external to the compartment 22. The condenser tubing 38 has a serpentine configuration and is secured to an interior surface of a rear wall 18 of the outer cabinet 12 so as to form what is commonly known as a "hot wall".

During an operating cycle of the refrigeration system, the compressor withdraws vaporized refrigerant from the evaporator 40 and discharges hot compressed refrigerant to the condenser tubing 38. The compressed refrigerant condenses to a liquid in the condenser tubing 38 and discharges its heat through the rear wall 18 to the outside environment. From the condenser tubing 38, the liquid refrigerant passes to the capillary tube and thence the evaporator 40. The capillary tube maintains a pressure drop between the condenser tubing 38 and the evaporator 40. The pressure drop causes the refrigerant to vaporize in the evaporator 40. The vaporization of the refrigerant in the evaporator 40 draws heat from the compartment 22, thereby cooling or refrigerating the compartment 22.

The evaporator 40 is mounted to a rear wall 24 of the liner 14, toward the top wall 26. The evaporator 40 has a conventional construction and includes a serpentine refrigerant tube 42 and spaced-apart vertical fins 44. An electric resistance type defrost heater 46 (shown in FIG. 3) is disposed within the evaporator 40, toward a bottom end thereof. An air flow and condensate system causes air to flow between the fins 44 and over the refrigerant tube 42. The air flow and condensate system includes a fan assembly 52, an evaporator cover 60, a drain plate 70, a grate 80, a drain trough 90 and a drain tube 94.

Figure 3:
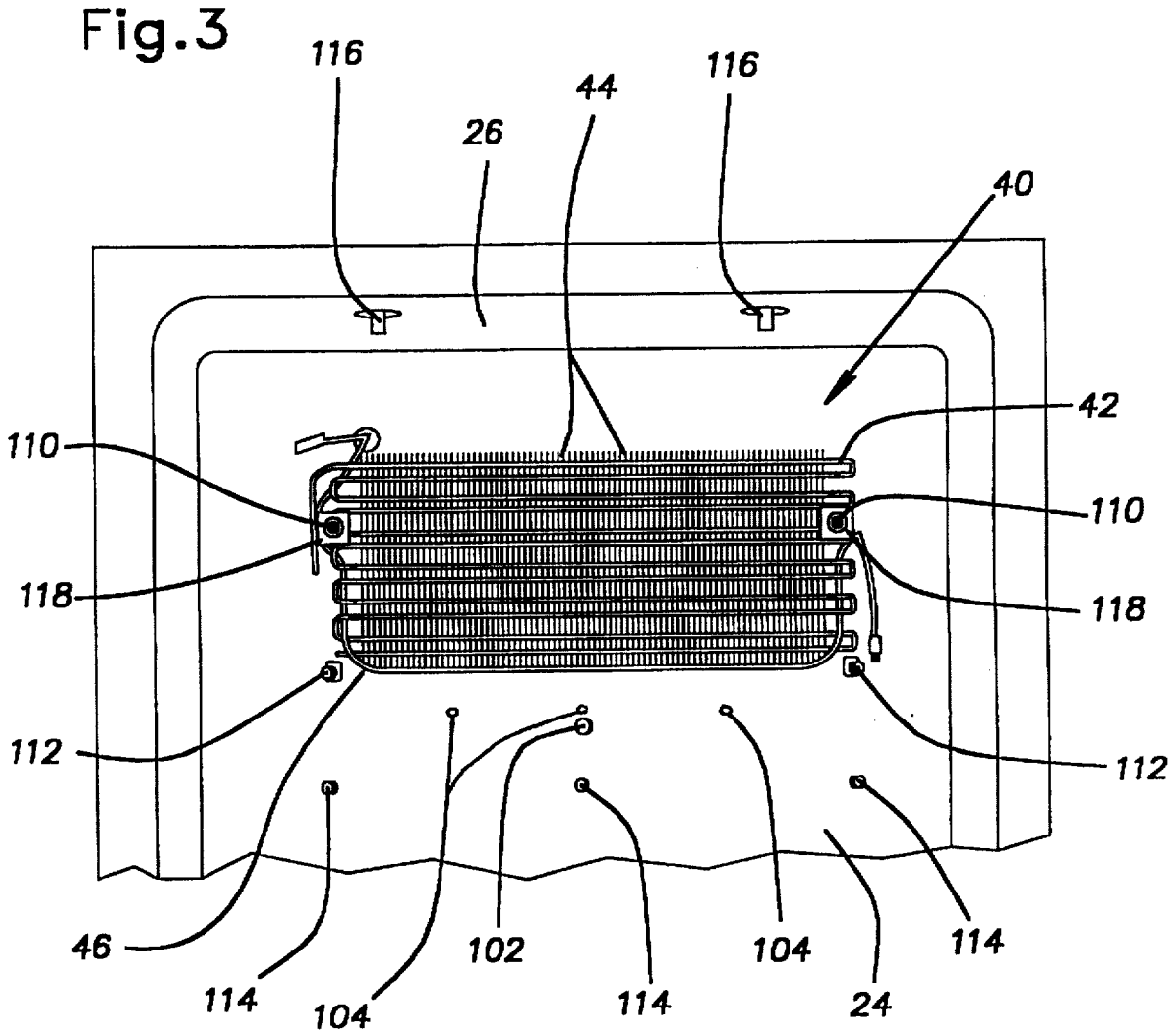
FIG. 3 shows an enlarged front perspective view of a portion of the refrigeration unit with an air flow and condensate system removed.

Referring now to FIG. 3, there is shown an enlarged front perspective view of a portion of the refrigeration unit 10 with the air flow and condensate system removed to better show the evaporator 40 and the rear and top walls 24, 26. A passage extends through the liner 14 and the cabinet 12, and opens into the compartment 22 through a drain hole 102 formed in the rear wall 24 of the liner 14. The drain hole 102 is spaced downward from the evaporator 40. Mounting holes 104 are disposed above the drain hole 102.

A pair of upper horizontal mounts 110, a pair of intermediate horizontal mounts 112 and three lower horizontal mounts 114 are formed in the rear wall 24 of the liner 14 and extend inward, toward the front opening 16. A pair of vertical mounts 116 are formed in the top wall 26 of the liner 14 and extend downward, toward the bottom wall 28. The upper, intermediate, and lower horizontal mounts 110, 112, 114 and the vertical mounts 116 are each generally cylindrical and define a threaded bore.

The upper horizontal mounts 110 are respectively disposed toward the side walls 30 and extend between sections of the refrigerant tube 42. The upper horizontal mounts 110 are fitted with retention blocks 118. The retention blocks 118 are disposed over sections of the refrigerant tube 42 and help secure the evaporator 40 to the rear wall 24 of the liner 14. The intermediate horizontal mounts 112 are also respectively disposed toward the side walls 30, and are positioned just below the evaporator 40. The lower horizontal mounts 114 extend between the side walls 30 and are spaced-apart in a substantially even manner. The lower horizontal mounts 114 are disposed below the drain hole 102.

Figure 4:
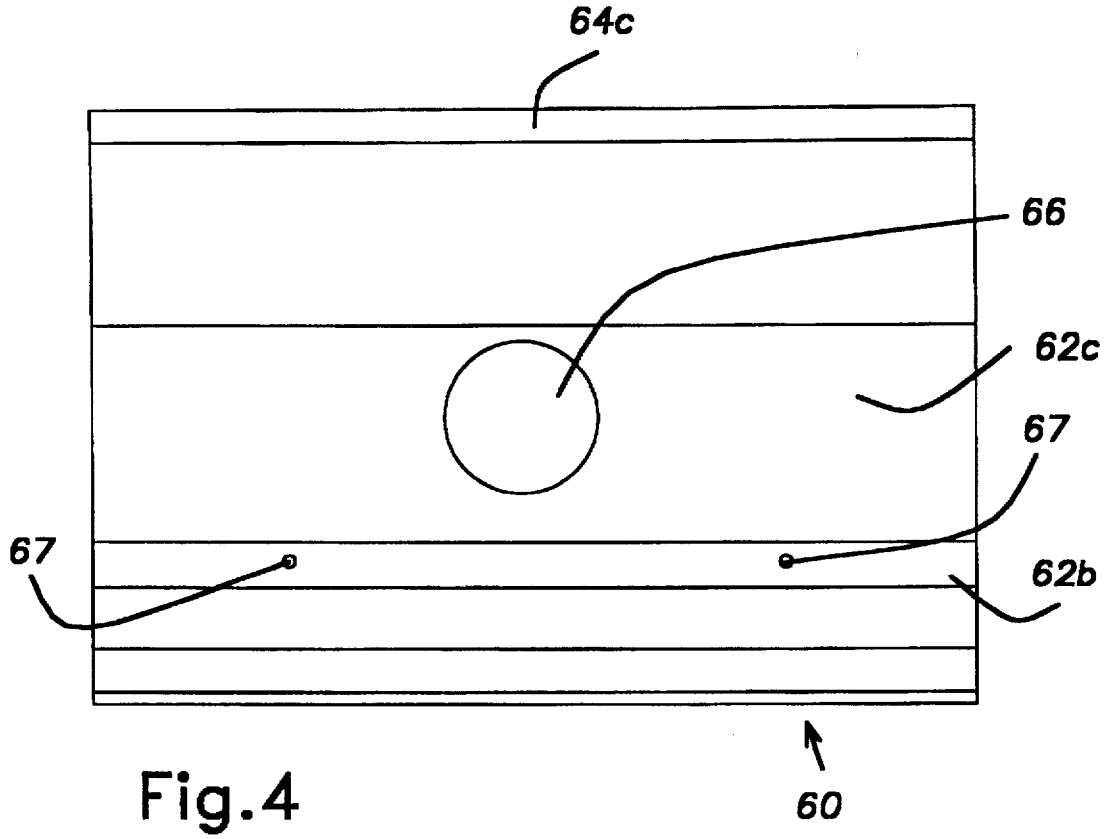
FIG. 4 shows a top view of an evaporator cover.
Figure 5:
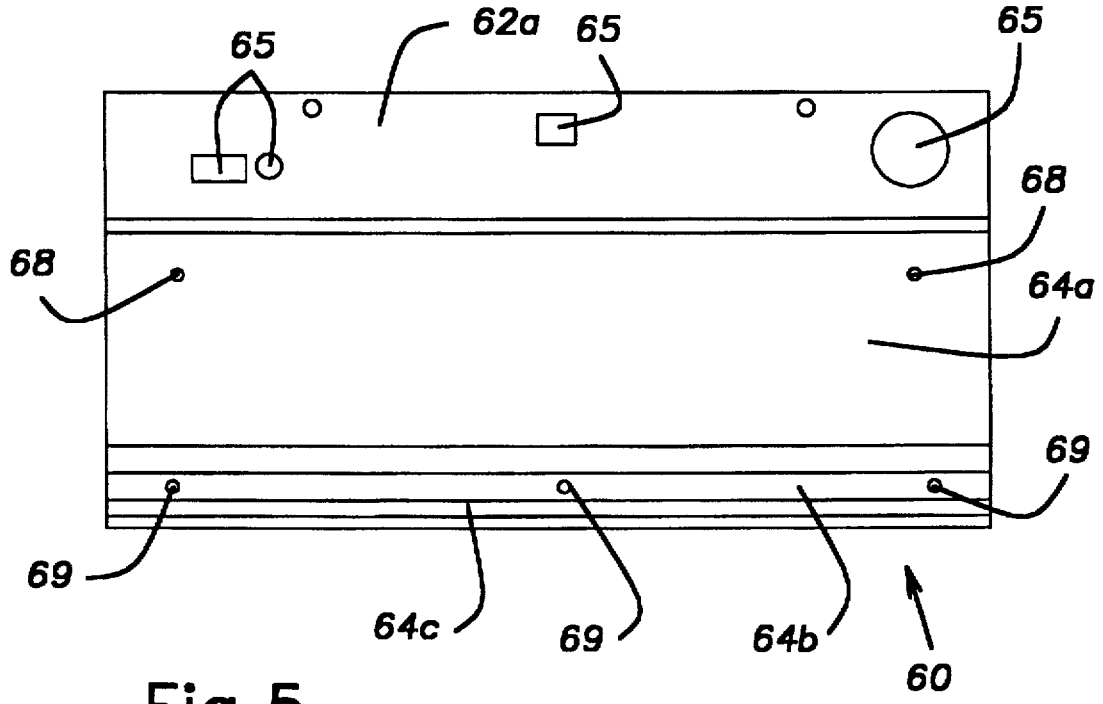
FIG. 5 shows a front view of the evaporator cover.

Referring now to FIGS. 4, 5, 6, there is respectively shown a top view, a front view, and a side view of the evaporator cover 60. The evaporator cover 60 is comprised of a steel panel bent into a generally L-shaped configuration having a plurality of faces. The evaporator cover 60 has an upper portion 62 and a rear portion 64.

The upper portion 62 of the evaporator cover 60 includes a front face 62*a*, a top face 62*b* and a top sloping face 62*c*, all of which have side flanges. The front face 62*a* is substantially vertical and defines a plurality of cut-outs 65. The top sloping face 62*c* angles downwardly and rearwardly, and defines an enlarged circular outlet opening 66. The top face 62*b* is substantially horizontal and defines a pair of holes 67.

The rear portion 64 of the evaporator cover 60 includes an upper rear face 64*a*, a lower rear face 64*b*, a sloping rear face 64*c* and a lip 64*d*. The upper rear face 64*a* has side flanges and is substantially vertical. The upper rear face 64*a* defines a pair of holes 68 respectively located toward the side flanges of the upper rear face 64*a*. The lower rear face 64*b* is also substantially vertical and defines a plurality of holes 69. The holes 69 extend between side edges of the lower rear face 64*b* and are spaced-apart in a substantially even manner. The sloping rear face 64*c* angles downwardly and rearwardly from the lower rear face 64*b*, and terminates at the lip 64*d*, which extends downwardly.

Referring back to FIG. 2, the evaporator cover 60 is shown mounted inside the compartment 22. The top face 62*b* of the evaporator cover 60 is secured to the top wall 26 of the liner 14 by screws 136, which extend through the holes 67 in the top face 62*b* and are threadably received in the bores of the vertical mounts 116. The upper rear face 64*a* of the evaporator cover 60 is secured to the rear wall 24 of the liner 14 by screws 130, which extend through the holes 68 in the upper rear face 64*a* and are threadably received in the bores of the upper horizontal mounts 110. The lower rear face 64*b* is secured to the rear wall 24 by screws 132, which extend through an outer pair of the holes 69 and are threadably received in the bores of the intermediate horizontal mounts 112.

With the evaporator cover 60 secured to the liner 14 in the foregoing manner, the rear portion 64 of the evaporator cover 60 is spaced forward from the rear wall 24 of the liner 14 so as to form an evaporator channel 76 therewith. In addition, the upper portion 62 of the evaporator cover 60 is spaced downward from the top wall 26 of the liner 14 so as to form a top channel 74 therewith. The evaporator channel 76 accommodates the evaporator 40 and has an inlet formed between the lip 64*d* and the rear wall 24. The evaporator channel 76 and the top channel 74 adjoin each other.

The fan assembly 52 is disposed in the top channel 74. The fan assembly 52 includes an electric motor 54 secured to a housing 56. The motor 54 receives electric power from an electrical system (not shown) of the refrigeration unit 10 and drives a blade assembly (not shown). The blade assembly is enclosed within the housing 56. The housing 56 is secured to the top sloping face 62*c* of the evaporator cover 60 such that the blade assembly is disposed over the outlet opening 66 and is substantially concentric therewith. In this manner, the blade assembly is angled forwardly and downwardly. The blade assembly is configured to draw air into the fan assembly 52 from the top channel 74 and the evaporator channel 76, and to expel it through the outlet opening 66 into the compartment 22.

Referring now to FIG. 7, there is shown an enlarged front perspective view of a portion of the refrigeration unit 10 with the evaporator cover 60 mounted to the liner 14. The drain plate 70 has been removed to better show the drain trough 90 and the grate 80. The drain trough 90 is generally channel-shaped and has an open top. The drain trough 90 extends the width of the rear wall 24 and has opposing end walls 91 respectively disposed adjacent to the side walls 30 of the liner 14. The drain trough 90 is secured to the rear wall 24 of the liner 14 by screws 134 that extend through bores formed in the drain trough 90 and are threadably received in the mounting holes 104 in the rear wall 24 of the liner 14. The drain trough 90 is aligned below the lip 64*d* of the evaporator cover 60 so as to catch condensate flowing down the sloping rear face 64*c*.

A drain opening 93 (shown in FIG. 2) is formed in a rear wall 95 (shown in FIG. 2) of the drain trough 90, adjacent to a bottom wall 96 of the drain trough 90. The drain opening 93 is aligned with the drain hole 102 in the rear wall 24 of the liner 14 so as to be concentric therewith. A drain tube 94 (shown in FIG. 2) adjoins the rear wall 95 around the drain opening 93. The drain tube 94 slopes rearwardly and downwardly from the drain trough 90. The drain tube 94 extends through the passage in the liner 14 and down to a heated drain pan (not shown). From each of the ends 91, the bottom wall 96 of the drain trough 90 slopes inward, toward the drain opening 93, and rearward, toward the rear wall 95. In this manner, condensate collected in the drain trough 90 flows into the drain opening 93 and thence the drain tube 94.

The grate 80 has a wire frame construction, and is comprised of an upper horizontal wire segment 82, an intermediate horizontal wire segment 87, a lower horizontal wire segment 84, and a plurality of vertical wire segments 83. Each of the vertical wire segments 83 has an angular shape and is joined to the upper, intermediate and lower horizontal wire segments 82, 87, 84 at substantially right angles. Mounting tabs 85 are joined to the upper horizontal wire segment 82 and extend downward therefrom. Each of the mounting tabs 85 defines an opening. The upper horizontal wire segment 82 is spaced outward, away from the rear wall 24 of the liner 14. The grate 80, however, angles downwardly and rearwardly such that the lower horizontal wire segment 84 is disposed adjacent to the rear wall 24 of the liner 14.

Referring back to FIGS. 1, 2, the drain plate 70 is shown mounted within the compartment 22. The drain plate 70 is composed of steel and is substantially rectangular. An upper opening and a pair of lower openings are formed in the drain plate 70. An upper portion of the drain plate 70 is secured over the lower rear face 64*b* of the evaporator cover 60 by a screw (not shown), which extends through the upper opening in the drain plate 70 and is threadably received in a middle one of the holes 69 in the lower rear face 64*b*. A lower portion of the drain plate 70 is secured over the upper horizontal wire segment 82 by screws 86, which extend through both the lower openings in the drain plate 70 and the openings in the mounting tabs 85. The screws 86 are threadably received in the bores of the lower horizontal mounts 114. In this manner, the screws 86 secure both the grate 80 and the lower portion of the drain plate 70 to the rear wall 24.

With the drain plate 70 secured to the rear wall 24 in the foregoing manner, the drain plate 70 is spaced forward from the rear wall 24 so as to form a drain channel 77 having a downwardly-opening inlet 78. The drain channel 77 adjoins the evaporator channel 76 to form a rear channel. Together, the top channel 74 and the rear channel form an air flow channel through which air is recirculated in the compartment 22.

During various cycles of the refrigeration cycle, the fan assembly 52 draws air through the drain channel 77, over the drain trough 90, and into the evaporator channel 76. Air flows upward through the evaporator channel 76 and the top channel 74, and is expelled into the compartment 22 through the outlet opening 66 in the top sloping face 62*c* of the evaporator cover 60. During the operating cycle of the refrigeration system, the evaporator 40 cools the air passing through the evaporator channel 76. Moisture is removed from the air and collects on the evaporator as condensate.

The condensate freezes and forms ice on the evaporator 40. In order to periodically melt the ice, the refrigeration system has a defrost cycle wherein the compressor is stopped and the defrost heater 46 is energized to melt the ice on the evaporator 40.

Liquid condensate on the evaporator 40 flows downward, toward the drain trough 90. Some of the condensate falls directly into the drain trough 90, while some of the condensate contacts the sloping rear face 64*c* of the evaporator cover 60. The sloping rear face 64*c* angles downwardly and rearwardly toward the drain trough 90 and, thus serves as a baffle or deflector to direct the condensate into the drain trough 90.

Condensate received in the drain trough 90 flows through the drain opening 93 and into the drain tube 94. The condensate flows through the drain tube 94 to the heated pan, where the condensate is evaporated. The proximity of the defrost heater 46 to the drain trough 90 enables the defrost heater 46 to heat the drain trough 90 and the drain tube 94, thereby preventing ice from forming therein.

It should be appreciated that the refrigeration unit 10 provides numerous benefits with regard to condensate drainage. The sloping rear face 64*c* of the evaporator cover 60 guides condensate into the drain trough 90, thereby preventing condensate from falling past the drain trough 90 and contacting packages and other items disposed below the drain trough 90. In addition, the drain plate 70 prevents packages and other items from being positioned between the inlet of the evaporator channel 76 and the drain trough 90, where the packages and other items would be contacted by condensate dripping into the drain trough 90. The location of the defrost heater 46 close to the drain trough 90 prevents condensate in the drain trough 90 and the drain tube 94 from freezing.

It should also be appreciated that the present invention provides numerous benefits with regard to air flow. The grate 80 prevents packages and other items from being pressed up against the lower portion of the drain plate 70 and blocking air flow into the inlet 78. The downward and rearward slope of the grate 80 helps prevent packages and other items from being disposed flush against the grate 80 and blocking air flow through the grate 80. Similarly, the downward and rearward slope of the top sloping face 62*c* helps prevent packages and other items from being disposed flush against the top sloping face 62*c* and blocking air flow through the outlet opening 66. By helping prevent blockages at the inlet 78 and the outlet opening 66, the present invention helps maintain a uniform temperature distribution throughout the compartment 22.

Although the preferred embodiment of this invention has been shown and described, it should be understood that various modifications and rearrangements of the parts may be resorted to without departing from the scope of the invention as disclosed and claimed herein. For example, instead of being integrally joined together, the upper portion 62 and the rear portion 64 of the evaporator cover 60 can be separate panels secured together by screws or other fastening means.

What is claimed is:

1. A refrigeration unit for holding storage items to be refrigerated, said refrigeration unit comprising:

an insulated enclosure defining a compartment, said enclosure having a top wall, a rear wall and opposing side walls;

an evaporator disposed within the compartment and secured to the rear wall;

a drain trough secured to the rear wall below the evaporator;

an evaporator plate covering the evaporator and having a lower portion sloping rearwardly and downwardly toward the drain trough, said lower portion directing condensate from the evaporator into the drain trough; and a drain plate covering the lower portion of the evaporator plate and the drain trough so as to prevent storage items from coming into contact with condensate dripping into the drain trough from the lower portion of the evaporator plate, said drain plate, in conjunction with the evaporator plate, forming a rear channel with the rear wall.

2. The refrigeration unit of claim 1 further comprising:

a top plate defining an opening, said top plate being spaced downward from the top wall so as to form a top channel therewith, said top channel adjoining the rear channel;

a fan disposed over the opening in the top plate, said fan being operable to draw air through the rear channel and the top channel, and to expel the air into the compartment through the opening.

3. The refrigeration unit of claim 2 wherein the top plate comprises an angled portion defining the opening, said angled portion sloping downwardly and rearwardly toward the rear wall so as to help prevent storage items from being disposed flush against the angled portion and blocking air flow through the opening.

4. The refrigeration unit of claim 2 wherein the top plate and the evaporator plate are integrally joined together and extend between the side walls.

5. The refrigeration unit of claim 4 wherein the top plate and the evaporator plate are composed of steel.

6. The refrigeration unit of claim 1 wherein the drain trough extends between the side walls and defines a drain opening.

7. The refrigeration unit of claim 6 further comprising a drain tube extending through the rear wall and adjoining the drain trough around the drain opening.

8. The refrigeration unit of claim 1 wherein a lower end of the drain plate is spaced forward from the rear wall so as to form an inlet for the rear channel.

9. The refrigeration unit of claim 8 further comprising a grate covering the inlet to the rear channel so as to prevent storage items from being pressed up against the lower end of the drain plate and blocking air flow into the inlet of the rear channel.

10. The refrigeration unit of claim 9 wherein the grate slopes downwardly and rearwardly to the rear wall so as to help prevent storage items from being disposed flush against the grate and blocking air flow through the grate.

11. The refrigeration unit of claim 1 wherein the refrigeration unit further comprises a defrost heater disposed in a bottom portion of the evaporator, toward the drain trough, said defrost heater being operable to defrost the evaporator and heat the drain trough so as to prevent ice formation therein.

12. A refrigeration unit for holding storage items to be refrigerated, said refrigeration unit comprising;

an insulated enclosure defining a compartment, said enclosure having a top wall, a rear wall and opposing side walls;

a rear plate spaced forward from the rear wall so as to form a rear channel therewith, said rear plate having a lower end spaced forward from the rear wall so as to form an inlet for the rear channel;

an evaporator disposed within the rear channel;

a drain trough disposed within the rear channel below the evaporator; and a grate covering the inlet to the rear channel so as to prevent storage items from being pressed up against the lower end of the rear plate and blocking air flow into the inlet of the rear channel wherein the grate slopes downwardly and rearwardly to the rear wall so as to help prevent storage items from being disposed flush against the grate and blocking air flow through the grate.

13. The refrigeration unit of claim 12 further comprising:

a top plate having an angled portion defining an opening, said top plate being spaced downward from the top wall so as to form a top channel therewith, said top channel adjoining the rear channel; and a fan disposed within the top channel and secured over the opening so as to be angled, said fan being operable to draw air through the rear channel and the upper channel, and to expel the air into the compartment through the opening at an angle.

14. The refrigeration unit of claim 13 wherein the rear plate is comprised of a drain plate secured to an evaporator plate.

15. The refrigeration unit of claim 14 wherein the top plate and the evaporator plate are integrally joined together and are formed from steel.

16. The refrigeration unit of claim 14 wherein the evaporator plate has a lower portion sloping rearwardly and downwardly toward the drain trough, said lower portion directing condensate from the evaporator into the drain trough.

17. A refrigeration unit for holding storage items to be refrigerated, said refrigeration unit comprising:

an insulated enclosure defining a compartment, said enclosure having a top wall, a rear wall and opposing side walls;

an evaporator disposed within the compartment and secured to the rear wall;

a drain trough secured to the rear wall below the evaporator;

an evaporator plate covering the evaporator and forming an evaporator channel with the rear wall, said evaporator plate having a lower portion sloping rearwardly and downwardly toward the drain trough, said lower portion directing condensate from the evaporator into the drain trough;

a top plate having an angled portion defining an opening, said top plate being spaced downward from the top wall so as to form a top channel therewith, said top channel adjoining the evaporator channel; and a fan disposed within the top channel and secured over the opening so as to be angled, said fan being operable to draw air through the evaporator channel and the top channel, and to expel the air into the compartment through the opening at an angle.

18. The refrigeration unit of claim 17 further comprising a grate secured to the rear wall below the drain trough.

19. The refrigeration unit of claim 18 further comprising a drain plate having an upper end secured over the evaporator plate and a lower end secured over the grate, said drain plate covering the lower portion of the evaporator plate and the drain trough so as to prevent storage items from coming into contact with condensate dripping into the drain trough from the lower portion of the evaporator plate.

20. The refrigeration unit of claim 17 wherein the refrigeration unit is a freezer.

21. The refrigeration unit of claim 17 wherein the refrigeration unit is a refrigerator.

* * * * *